US006422773B1

(12) United States Patent
Lim

(10) Patent No.: US 6,422,773 B1
(45) Date of Patent: Jul. 23, 2002

(54) METHOD OF DETECTING AMOUNT OF REMAINING SHEETS OF PAPER

(75) Inventor: Kwang-taek Lim, Kwangmyung (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/473,999

(22) Filed: Dec. 29, 1999

(30) Foreign Application Priority Data

Jan. 26, 1999 (KR) ..... 99-2400

(51) Int. Cl.[7] ..... B41J 29/18

(52) U.S. Cl. ..... 400/710; 400/703; 271/9.03; 271/127; 271/145

(58) Field of Search ..... 400/710, 703, 400/708, 624; 221/2, 6; 271/9.03, 127, 145, 157, 160, 162, 164; 399/23; 116/303, 284, 296; 340/540, 568, 612, 679

(56) References Cited

U.S. PATENT DOCUMENTS

| | | | | | |
|---|---|---|---|---|---|
| 4,535,463 | A | * | 8/1985 | Ito et al. | 377/8 |
| 4,566,547 | A | * | 1/1986 | Furukawa | 177/46 |
| 4,835,573 | A | * | 5/1989 | Rohrer et al. | 399/23 |
| 4,928,949 | A | * | 5/1990 | Ramsey et al. | 271/111 |
| 5,008,715 | A | * | 4/1991 | Imaizumi et al. | 399/392 |
| 5,236,348 | A | * | 8/1993 | Fetherolf et al. | 400/703 |
| 5,629,672 | A | * | 5/1997 | Brown et al. | 340/540 |
| 5,700,003 | A | * | 12/1997 | Sung | 271/110 |
| 5,960,230 | A | * | 9/1999 | Peter | 399/23 |

* cited by examiner

*Primary Examiner*—Ren Yan
*Assistant Examiner*—Minh H. Chau

(57) ABSTRACT

A method of detecting the amount of remaining sheets of paper in a paper feeding cassette of a printing apparatus, wherein the printing apparatus receives a paper feeding cassette having a knock-up plate on which paper is placed, and which pivots as paper is removed therefrom, a pickup roller installed in the printing apparatus which elastically moves up and down within a predetermined range to contact the paper, the pickup roller being made to rotate in close contact with the paper to sequentially feed the paper into the printing apparatus, a lifting mechanism which lifts the knock-up plate step by step according to the consumption of paper, thereby placing the loaded paper against the pickup-roller, calculating a difference in the number of operations of the lifting mechanism for lifting the knock-up plate toward the pickup roller when a maximum number of sheets of paper is loaded into the paper feeding cassette and when only a single sheet of paper is placed in the paper feeding cassette, calculating an amount of consumed paper per one operation of the lifting mechanism as a set value from the calculated difference, lifting the knock-up plate when the paper feeding cassette enters into the printing apparatus until the loaded paper closely contacts the pickup roller, and counting the number of operations of the lifting mechanism, and calculating the amount of paper remaining in the paper feeding cassette based on the number of operations counted and the set value calculated. As a result, a user is always able to roughly determine how many sheets of paper are left in the cassette, thereby avoiding situations where the printing job is stopped due to a lack of paper.

3 Claims, 5 Drawing Sheets

METHOD OF DETECTING AMOUNT OF REMAINING SHEETS OF PAPER

BACKGROUND OF THE INVENTION

1. Field of the Invention

The present invention relates to a method of automatically detecting the amount of remaining sheets of paper in a paper feeding cassette of a printing apparatus.

2. Description of the Related Art

For instance, a cassette 20 containing a plurality of sheets of paper S is detachably installed in a printing apparatus such as a printer or copier, as shown in FIG. 1. A pickup roller 11 closely contacting the uppermost surface of the stack of paper S in the cassette 10 when the cassette 20 is coupled to a main body 10 of the printing apparatus so that the stack of paper S is provided one by one through a paper feeding path according to rotation of the pickup roller 11.

However, in the conventional printing apparatus, when the stack of paper S, in the cassette 20, is gradually consumed during a printing job, a user cannot see how many sheets of paper S are left in the cassette 20 unless the cassette 20 is drawn out of the main body 10. Thus, there frequently are cases in which the printing job is stopped due to lack of paper. Additionally, it is inconvenient to check the amount of paper remaining prior to a printing job by drawing the cassette 20 out, thereby preventing the above problem. Therefore, there exists a need for a method of detecting the amount of paper remaining in the cassette 20, without drawing the cassette 20 out of the main body 10.

SUMMARY OF THE INVENTION

To solve the above problem, it is an objective of the present invention to provide a method of detecting the amount of remaining sheets of paper in a cassette, without drawing the cassette out of the main body of a printing apparatus.

Accordingly, to achieve the above objective, there is provided a method of detecting the amount of remaining sheets of paper in a paper feeding cassette of a printing apparatus, wherein the printing apparatus receives a paper feeding cassette having a knock-up plate on which paper is placed, and which pivots as paper is removed therefrom, a pickup roller installed in the printing apparatus which elastically moves up and down within a predetermined range to contact the paper, the pickup roller being made to rotate in close contact with the paper to sequentially feed the paper into the printing apparatus, a lifting mechanism which lifts the knock-up plate step by step according to the consumption of paper, thereby placing the loaded paper against the pickup-roller, calculating a difference in the number of operations of the lifting mechanism for lifting the knock-up plate toward the pickup roller when a maximum number of sheets of paper is loaded into the paper feeding cassette and when only a single sheet of paper is placed in the paper feeding cassette, calculating an amount of consumed paper per one operation of the lifting mechanism as a set value from the calculated difference, lifting the knock-up plate when the paper feeding cassette enters into the printing apparatus until the loaded paper closely contacts the pickup roller, and counting the number of operations of the lifting mechanism, and calculating the amount of paper remaining in the paper feeding cassette based on the number of operations counted and the set value calculated.

The present invention further includes a lifting mechanism for a printer apparatus, for receiving a paper feeding cassette having a knock-up plate on which paper is placed, comprising a rotation shaft installed in said printing apparatus which rotates a lift lever installed at one side thereof, thereby lifting said knock-up plate, a cam gear, driven by a driving source, which connects to said rotation shaft and rotates said rotation shaft a predetermined amount per one turn, and a solenoid which locks said cam gear at each turn by selectively interfering with a locking step formed on said cam gear, wherein the number of operations of said lifting mechanism is calculated by counting the number of operations of said solenoid.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
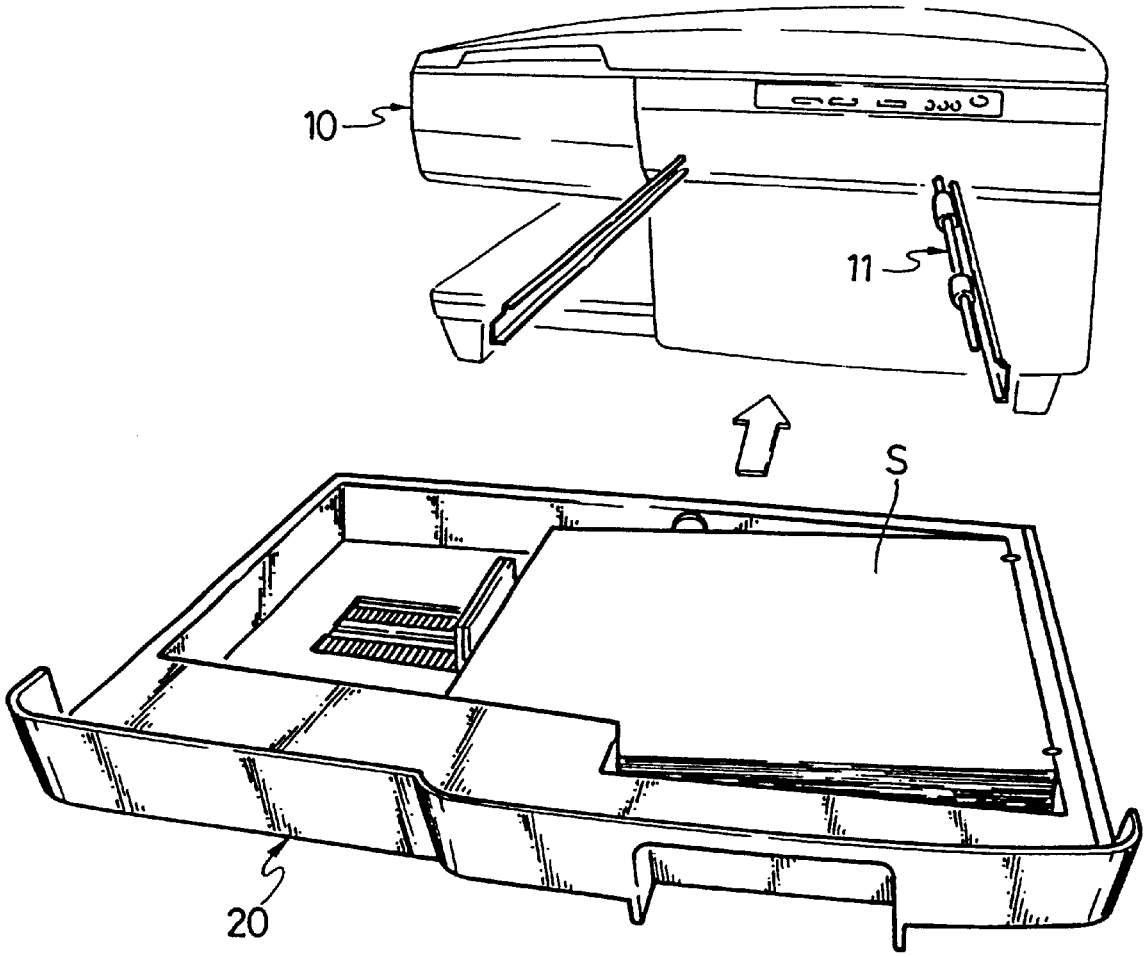
FIG. 1 (PRIOR ART)
FIG. 1 is a perspective view showing a typical printing apparatus.
Figure 2:
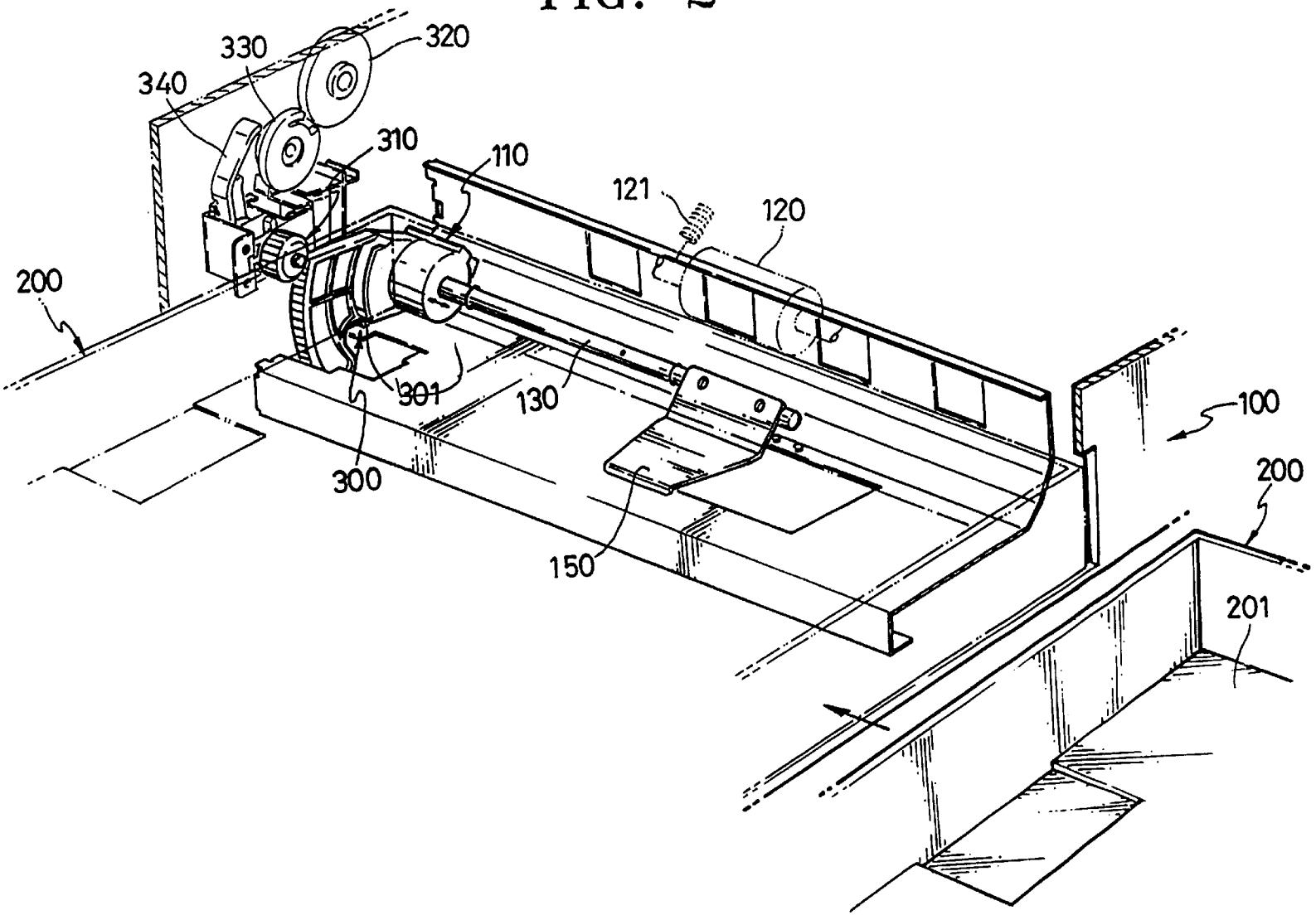
FIGS. 2 and 3 are a perspective view and an exploded perspective view, respectively, showing a paper feeding structure for detecting the number of sheets of paper remaining in a cassette according to the present invention.
Figure 3:
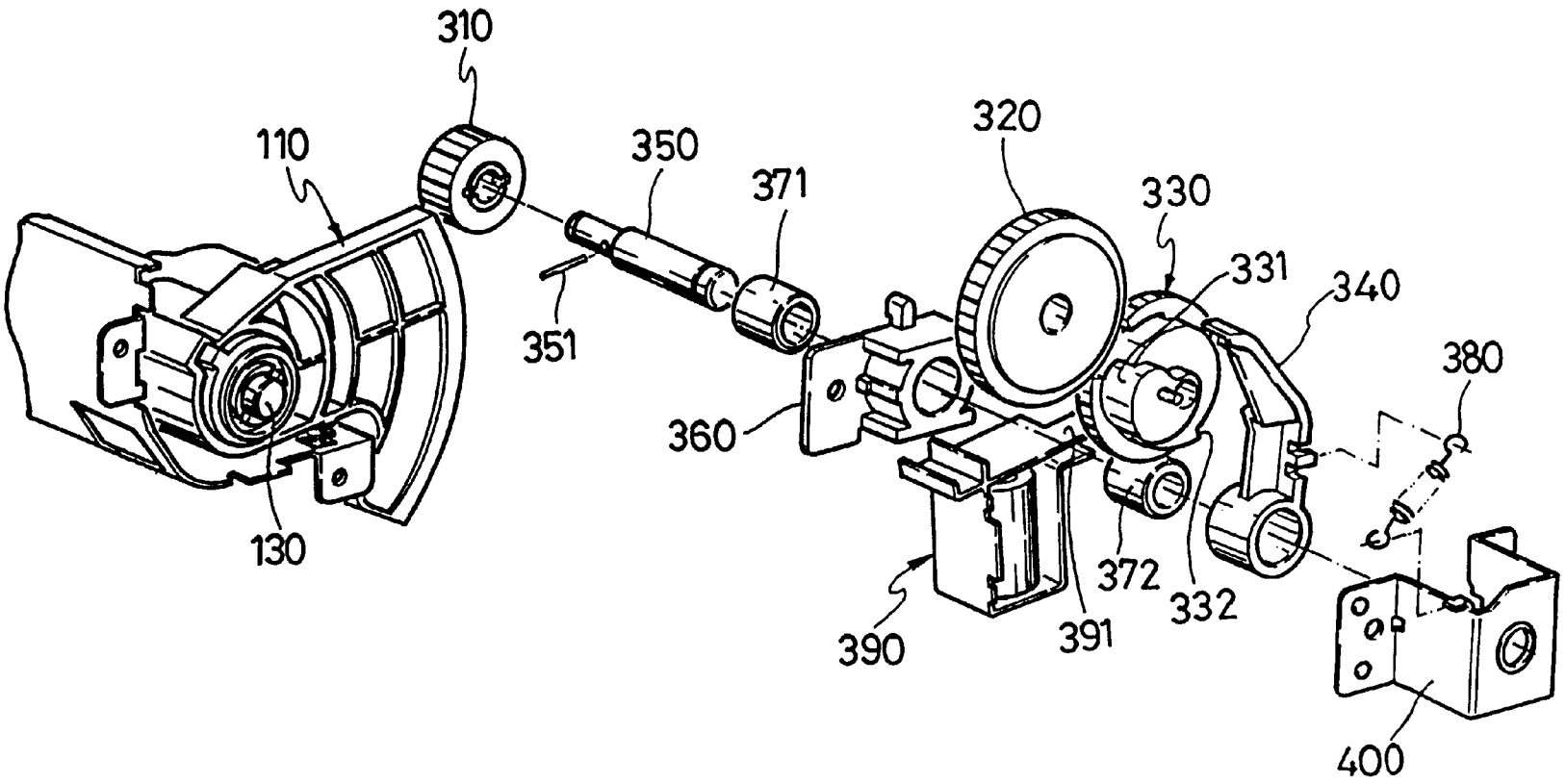

FIGS. 2 and 3 show an example of a paper feeding structure suitable for detecting the amount of remaining sheets of paper in a cassette according to the present invention. As shown in the drawing, a knock-up plate 201, which is capable of pivoting, is installed in a cassette 200 where sheets of paper are placed. A lifting means for lifting the knock-up plate 201 to allow the paper, stacked on the knock-up plate, to closely contact a pickup roller 120 is provided in a printing apparatus 100. The lifting means includes a rotation shaft 130 disposed under the knock-up plate 201 when the cassette 200 is installed in the printing apparatus 100. A lift lever 150 is coupled to the rotation shaft 130 so that the lift lever 150 lifts the knock-up plate 201 during rotation to allow the stacked paper to closely contact the pickup roller 120. To rotate the rotation shaft 130 a predetermined amount, there is provided a lift gear 310 engaged with a gear member 110, wherein the gear member 110 is coupled to the rotation shaft 130. A cam gear 330, having a predetermined cam surface 331 and a locking step 332 formed at one side thereof, is rotated to engage with a driving gear 320. A pivot lever 340 pivots according to the rotation of the cam gear 330 while closely contacting the cam surface 331. A connection shaft 350 connects the lift gear 310 and the pivot lever 340. A first forward direction bearing 371 is coupled to the outer circumference of the connection shaft 350 and inserted into a holder 360. A second forward direction bearing 372 is coupled to the outer circumference of the connection shaft 350 and inserted into the pivot lever 340. A tension spring 380 is provided for elastically pulling the pivot lever 340, and a solenoid 390 is provided for locking the rotation of the cam gear 330, by selectively interfering with the locking step 332 of the cam gear 330. The pickup roller 120 is elastically biased downward by a predetermined elastic member 121 and installed to be able to move up and down within a range of its elasticity. Reference numeral 351 denotes a coupling pin and reference numeral 400 denotes a supporting body for supporting the lifting means.

Figure 4:
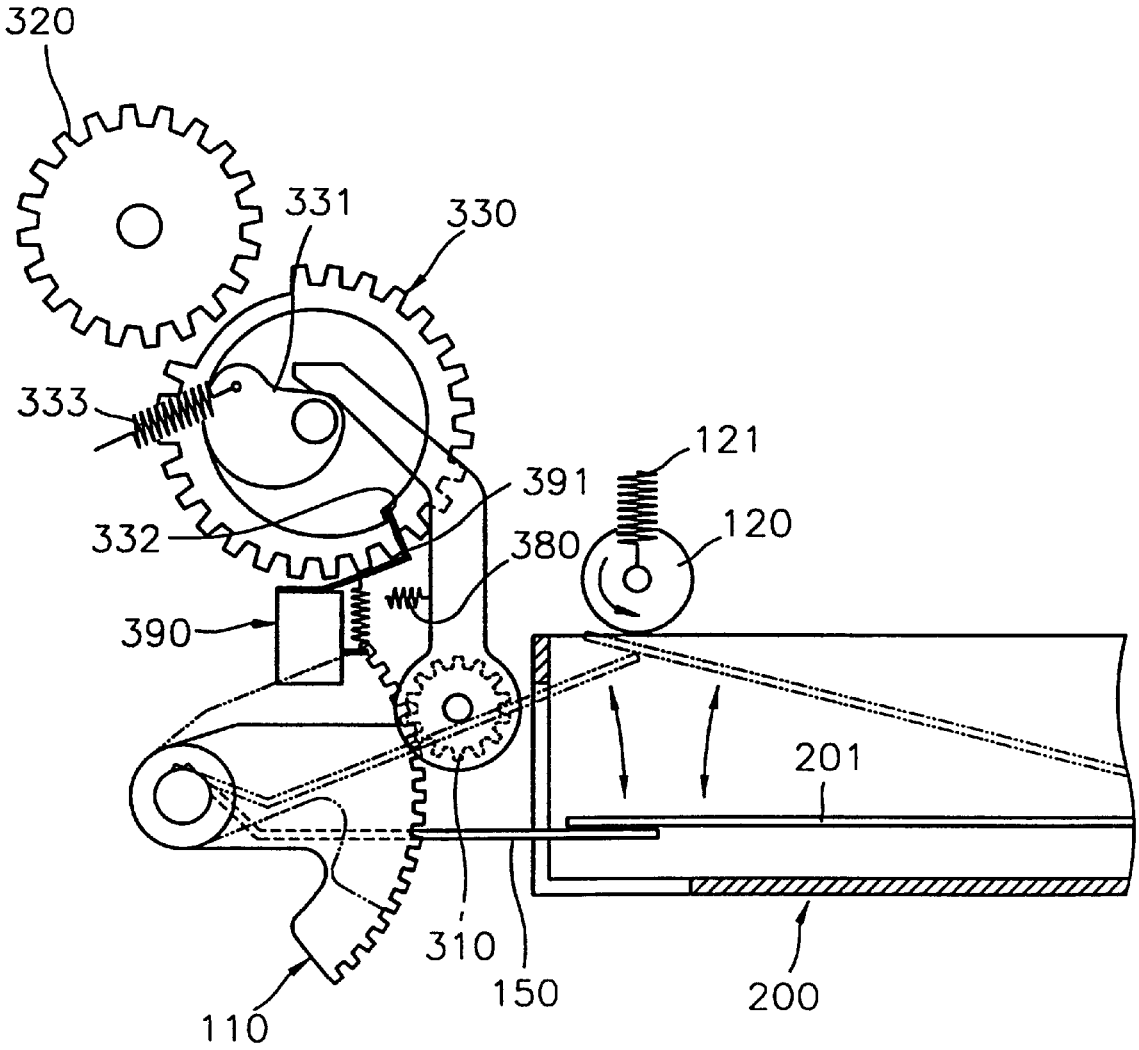
FIG. 4 is a simplified view showing the paper feeding structure showing in FIG. 2.

FIG. 4 shows a simplified paper feeding structure for convenience of explanation. In the above structure, when the knock-up plate 201 is lifted, a hooking piece 391 of the solenoid 390, hooked at the locking step 332, escapes therefrom and becomes unlocked. At this time, as the cam gear 330 is rotated slightly by the power converting spring 333, the cam gear 330 is engaged with the driving gear 320, which is connected to a driving source (not shown). Next, the cam gear 330 is rotated one turn by the driving gear 320. Here, the pivot lever 340, which is closely contacted by the cam surface 331, is moved along the curved surface of the cam surface 331 to rotate a predetermined amount and thereafter returned to its original position by the tension spring 380. At the instant the pivot lever 340 rotates along the cam surface 331, the lift gear 310, connected to the connection shaft 350, rotates a predetermined amount. However, when the pivot lever 340 is returned to its original position by the tension spring 380, the lift gear 310 does not rotate together, and only the pivot lever 340 returns to its original position. The lift gear 310 is rotated together, or not rotated, according to the rotational direction of the pivot lever 340, as a result of the installation of the second forward direction bearing 372. That is, when the pivot lever 340 is rotated in a direction of being pushed, the second forward direction bearing 372 rotates the connection shaft 350 connecting the lift gear 310 together, while being rotated in a return direction, therefore the pivot lever 340 remains idle. The first forward direction bearing 371 functions to prevent reverse rotation due to the weight of the paper after the lift gear 310 is rotated with the pivot lever 340.

When the lift gear 310 is rotated, the gear member 110 of the rotation shaft 130, engaged with the lift gear 310, is rotated. Accordingly, the lift lever 150 of the rotation shaft 130, lifts the knock-up plate 201 to a predetermined height. That is, at every complete rotation of the cam gear 330, the knock-up plate 201 is raised to a predetermined height by the power transferred through the pivot lever 340 and the lift gear 310. Thus, when the cassette 200 is first inserted, the knock-up plate 201 is lifted step by step, by rotating the cam gear 330 until the paper loaded on the knock-up plate 201 closely contacts the pickup roller 120. Then, after close contact is completed, the pickup roller 120 maintains the position as it is within a range of elastically pressing the paper down, for example, until 25 sheets of paper are consumed. When over 25 sheets of paper are consumed, the cam gear 330 rotates one turn to lift the knock-up plate 201 by one step so that the paper again closely contacts the pickup roller 120. As a result, after the cassette 200 is inserted and the pickup roller 120 closely contacts the paper, the knock-up plate 201 is lifted by one step by rotating the cam gear 320 one turn at each predetermined amount of consumed paper. Here, the solenoid 390 repeats on/off actions one time per turn for locking and releasing the cam gear 330.

For example, in the case of a cassette 200 accommodating a maximum of 500 sheets of paper, and the maximum amount is loaded, assuming that the cam gear 330 must be rotated two turns to make the pickup roller 120 contact the paper and also rotated twenty two turns until one sheet of paper is left, the number of rotations of the cam gear 330 until 500 sheets of paper are all consumed is 20, counting from the point when the paper contacts the pickup roller 120 by the initial basic rotation number. Thus, 25 sheets of paper are consumed per one turn of the cam gear 330 in the above example. However, as the solenoid 390 operates once for each turn of the cam gear 330, the number of rotations of the cam gear 330 can be obtained by checking the number of operations of the solenoid 390, which means how many times the knock-up plate 201 is lifted. The present method is to detect the above so that the amount of the paper remaining in the cassette 200 can be calculated.

Figure 5:
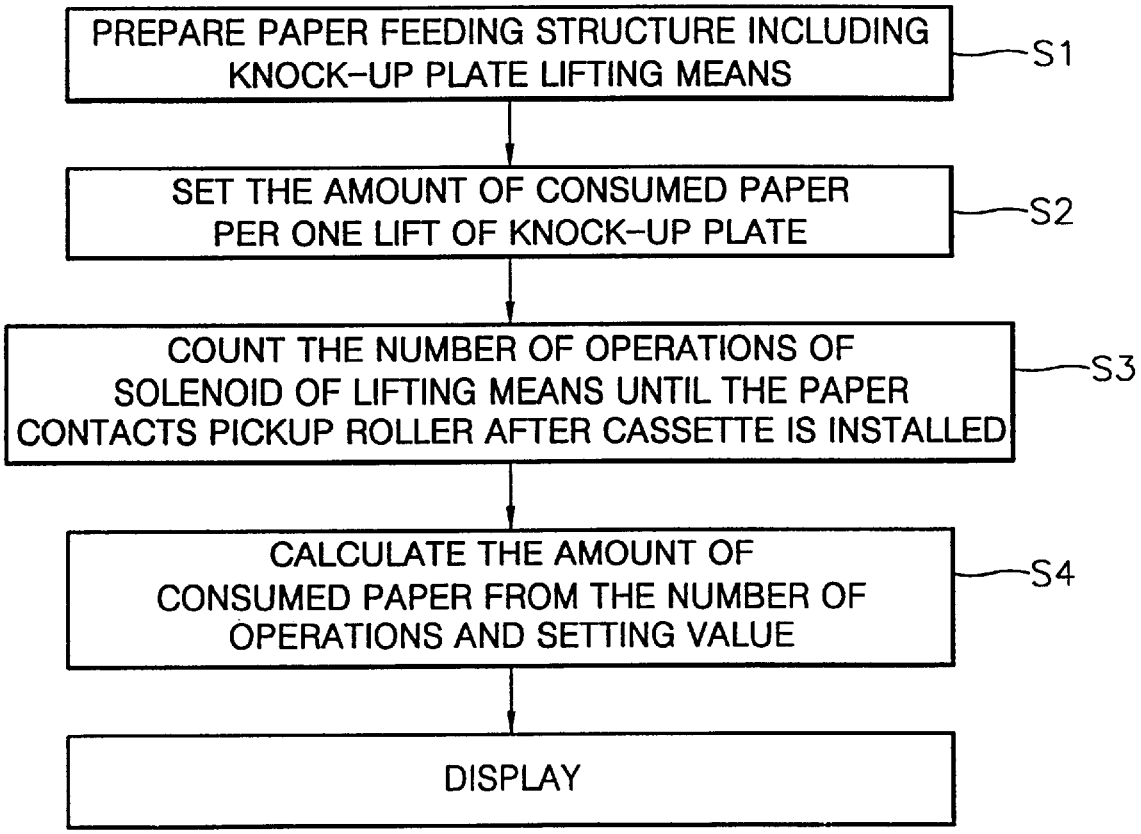
FIG. 5 is a flow chart for explaining a method of detecting the amount of remaining sheets of paper in a cassette according to the present invention.

To sequentially summarize the detection method, as shown in FIG. 5, the paper feeding structure above is prepared (S1) and the amount of sheets of paper consumed whenever the knock-up plate 201 is lifted by the above-mentioned lifting means is calculated as a set value (S2). That is, as described above, the difference in the number of operations of the solenoid 390 for lifting the knock-up plate 201 toward the pickup roller 120 when the maximum amount of sheets of paper is loaded in the cassette 200 and when only one sheet of paper is left in the cassette 200 is calculated and the amount of consumed paper per one operation of the solenoid 390 is calculated and set. Then, when the cassette 200 enters the printing apparatus 100, the knock-up plate 201 is lifted until the loaded paper closely contacts the pickup roller 120 and the number of operations of the solenoid 390 are counted (S3). Here, counting is performed in consideration of the basic rotation. Next, the amount of paper remaining in the cassette 200 is calculated, considering the counted number of operations and the set value above (S4). Then, when printing proceeds and as many sheets of paper is consumed as the number of the set value, the knock-up plate 201 is lifted one more step and it is detected that as many sheets of paper is consumed as the set value than the previous step. However, in the present example, as the position of the knock-up plate 201 is the same until 25 sheets of paper are consumed, the amount of paper calculated as remaining in cassette 200 is an approximation. Although the calculation does not provide an exact number of sheets of paper remaining in the cassette, it does provide a rough percentage of the amount of paper remaining compared to the maximum loading amount. Thus, by displaying the amount of paper remaining, a user can determine, without opening the cassette 200, whether a sufficient amount of paper is left in the cassette 200. As a result, a user is always able to roughly determine how many sheets of paper are left in the cassette 200, thereby avoiding situations where the printing job is stopped due to a lack of paper.

As described above, according to the paper feeding apparatus of the present invention, the amount of remaining sheets of paper in the cassette can be easily identified while the cassette is installed at the printing apparatus.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of detecting the amount of remaining sheets of paper in a paper feeding cassette of a printing apparatus, wherein said printing apparatus receives a paper feeding cassette having a knock-up plate on which paper is placed, and which pivots as paper is removed therefrom, a pickup roller installed in said printing apparatus which elastically moves up and down within a predetermined range to contact the paper, said pickup roller being made to rotate in close contact with the paper to sequentially feed the paper into said printing apparatus, a lifting mechanism which lifts said knock-up plate step by step according to the consumption of paper, thereby placing the loaded paper against said pickup-roller, said method comprising the steps of:

(a) calculating a difference in the number of operations of said lifting mechanism for lifting said knock-up plate toward said pickup roller when a maximum number of sheets of paper is loaded into said cassette and when only a single sheet of paper is placed in said cassette;

(b) calculating an amount of consumed paper per one operation of said lifting mechanism as a set value from the calculated difference of step (a);

(c) placing the paper onto said knock-up plate;

(d) lifting said knock-up plate when said paper feeding cassette enters into said printing apparatus until the loaded paper closely contacts said pickup roller, and counting the number of operations of said lifting mechanism, wherein the lifting step further comprises:

(d1) rotating a shaft installed in said printing apparatus which rotates a lift lever installed at one side thereof, thereby lifting said knock-up plate;

(d2) driving a cam gear connected to said rotating shaft of step (d1) to rotate said rotation shaft a predetermined amount per one turn; and (d3) locking said cam gear at each turn using a solenoid which selectively interferes with a locking step formed on said cam gear, wherein the number of operations of said lifting mechanism is calculated by counting the number of operations of said solenoid; and (e) calculating the amount of paper remaining in said cassette based on the number of operations counted in step (d) and said set value calculated in step (b).

2. A lifting mechanism for a printing apparatus, for receiving a paper feeding cassette having a knock-up plate on which paper is placed, comprising:

a rotation shaft installed in said printing apparatus which rotates a lift lever installed at one side thereof, thereby lifting said knock-up plate;

a cam gear, driven by a driving source, which connects to said rotation shaft and rotates said rotation shaft a predetermined amount per one turn; and a solenoid which locks said cam gear at each turn by selectively interfering with a locking step formed on said cam gear, wherein the number of operations of said lifting mechanism is calculated by counting the number of operations of said solenoid.

3. The lifting mechanism of claim 2, wherein said rotation shaft is located under said knock-plate.

* * * * *

UNITED STATES PATENT AND TRADEMARK OFFICE

CERTIFICATE OF CORRECTION

PATENT NO. : 6,422,773 B1
DATED : July 23, 2002
INVENTOR(S) : Kwang-taek Lim

It is certified that error appears in the above-identified patent and that said Letters Patent is hereby corrected as shown below:

Title page,
Item [56], References Cited, OTHER PUBLICATIONS, please insert the following:

-- PATENT ABSTRACTS OF JAPAN, vol. 017, no. 682 (M-1528), 14 December 1993 & JP 05 229674 A (RICOH CO LTD), 7 September 1993

PATENT ABSTRACTS OF JAPAN, vol. 1998, no. 11, 30 September 1998 & JP 10 161376 A (CANON INC), 19 June 1998 --

Signed and Sealed this

Seventh Day of January, 2003

JAMES E. ROGAN
*Director of the United States Patent and Trademark Office*